US006220718B1

(12) United States Patent
Burgess

(10) Patent No.: US 6,220,718 B1
(45) Date of Patent: Apr. 24, 2001

(54) FLOATING CANDLES

(76) Inventor: Gary D. Burgess, 1326 N. 1050 W., Orem, UT (US) 84057-2486

( * ) Notice: Subject to any disclaimer, the term of this patent is extended or adjusted under 35 U.S.C. 154(b) by 0 days.

(21) Appl. No.: 09/365,174

(22) Filed: Aug. 2, 1999

(51) Int. Cl.[7] ..... F21V 7/00

(52) U.S. Cl. ..... 362/101; 362/237; 362/244; 362/251; 362/252; 362/101; 362/249; 362/310; 362/382; 362/363; 362/267; 362/292; 362/158; 315/291; 315/307

(58) Field of Search ..... 362/237, 244, 362/251, 252, 101, 249, 310, 382, 363, 267, 392, 158; 315/291, 307

(56) References Cited

U.S. PATENT DOCUMENTS

| | | | | |
|---|---|---|---|---|
| D. 245,936 | | 9/1977 | Roush . | |
| D. 266,365 | | 9/1982 | Rosenbaum . | |
| 2,234,903 | | 3/1941 | Muench . | |
| 4,234,303 | | 11/1980 | Neugert . | |
| 4,839,784 | | 6/1989 | Lin . | |
| 5,072,348 | * | 12/1991 | Tsukada | 362/226 |
| 5,101,328 | | 3/1992 | Hai . | |
| 5,152,602 | | 10/1992 | Boschetto . | |
| 5,193,994 | | 3/1993 | Schirneker . | |
| 5,211,469 | * | 5/1993 | Matthias et al. | 362/101 |
| 5,863,180 | | 1/1999 | Lederer . | |
| 5,994,843 | * | 11/1999 | Kataoka et al. | 315/106 |
| 6,053,623 | * | 4/2000 | Jones et al. | 362/310 |
| 6,152,571 | * | 11/2000 | Ruiz | 362/101 |

* cited by examiner

*Primary Examiner*—Thomas M. Sember
*Assistant Examiner*—Anabel Ton
(74) *Attorney, Agent, or Firm*—Richard C. Litman

(57) ABSTRACT

An artificial floating candle that mimics real burning candles. The floating candle comprises two parts, a floating candle-like device and an electrical circuit that controls the amount of power supplied to each floating candle. The floating candle-like device comprises an incandescent lamp, a lamp housing socket, a candle, a candle base, grommets or O-rings, at least two conductor insulated wires, a multi conductor, a trunk line, a water tight splice, and a candle enclosure. There are three sections that comprise the electrical circuitry of the floating candles: a low voltage supply (AC to DC, high to low voltage conversion), a pulse width modulation programmed micro-controller and a power output section (to control the incandescent lamp voltage to produce flickering flames), and trunk and feeder lines. The floating candles may be used as Christmas lights, at wedding reception halls, amusements parks, or in pools or ponds at evening parties as decoration.

15 Claims, 6 Drawing Sheets

FLOATING CANDLES

BACKGROUND OF THE INVENTION

1. Field of the Invention

The present invention relates to artificial candles, and more specifically, to an artificial candle that mimics a real candle's flame which floats on water.

2. Description of the Related Art

The earliest evidence of the existence of candles has been found in Egypt. North American Indians in the first century made candles from burned oily fish wedged into a splintered stick. Candles over thousands of years have continued to be manufactured with very few changes, other than style and composition. Braided wicks and paraffin were introduced in the early 1800's. There have been several patents on floating candles. However, these candles are actual candles burning a structure made to float on water.

U.S. Des. Pat. No. 245,936, issued to Gary B. Roush on Sep. 27, 1977, and U.S. Pat. Des. No. 266,365, issued to Robert A. Rosenbaum on Sep. 28, 1982, both illustrate an ornamental design for a candle float. U.S. Pat. No. 2,234,903, issued to Thomas J. Muench on March 11, 1941, describes a floating candle. The candle is made of wax and is lighter than water. As it is consumed, it forms a hollow shell-like vessel of the candle material.

U.S. Pat. No. 4,234,303, issued to Fernando M. Neugert on Nov. 18, 1980, describes a two-part float assembly adapted to float upon a molten surface of fuel. U.S. Pat. No. 5,101,328, issued to Lee H. Hai on Mar. 31, 1992, describes a candle holder which includes a bowl having a recessed portion for receiving a candle, a housing securely attached to the bowl, and air inlet tubes for introducing fresh air into the housing. A floating member is provided for retaining an air inlet port of each air inlet tube to be above a water level when the candle holder is place into the water.

U.S. Pat. No. 5,193,994, issued to Hans-Ludwig Schirneker on Mar. 16, 1993, describes a candle with at least one body comprising a material which is solid at room temperature such as wax or paraffin and a wick. The top end of the candle has a tubular headpiece which surrounds the candle body and moves downwards with the burning-down of the candle.

All the above mentioned patents describe real combustible floating candles. The problem with combustible floating candles is the tendency for the water and surrounding air to extinguish the flames. The life of most candles is very short and usually measures in hours. Candles bring about a mystical and soothing aura, which has prompted the desire to construct a light source that appears candle-like but is powered by electricity to ensure a long life.

U.S. Pat. No. 4,839,784, issued to Ling-Young Lin on Jun. 13, 1989, describes a non-floating electrically powered candle-like lighting device having a candle body with a bulb disposed at the top that is mounted on a candle holder. The candle holder is further secured to a candle base and provided with a sucker at the concaved bottom in such a manner that the base can be spun freely with respect to the fixed sucker. U.S. Pat. No. 5,152,602, issued to Andrew Boschetto on Oct. 6, 1992, describes an electric candle that has an electrical circuit for sensing ambient light conditions and automatically turning on and off electrical current. U.S. Pat. No. 5,863,108, issued to Gabor Lederer on Jan. 26, 1999, describes a non-floating decorative holder for an electrically powered candle emulation device. The holder comprises a transparent hollow cylindrical member. Appropriate candle emulation electronics are placed into the holder to provide the effect of a wax candle contained within an etched and colored decorative holder.

Floating candles have been the trend at most weddings and social events. However, the real combustible floating candles tend to create a host of problems. An ideal floating candle would be powered by electricity and watertight. This would eliminate a problem caused by the smallest wind velocities that extinguish most burning candles. This would also prevent the tendency for the water in which the candles are floating to extinguish the burning candles. An electric candle would not be susceptible to being extinguished, therefore eliminating a need to re-light real combustible candles floating in the middle of a pond or pool.

None of the above inventions and patents, taken either singularly or in combination, is seen to describe the instant invention as claimed. Thus floating candles solving the aforementioned problems is desired.

SUMMARY OF THE INVENTION

The present invention is an electrically powered floating candle. The floating candle comprises two parts, a floating candle-like device and an electrical circuit that controls the amount of power supplied to the floating candle. The candle's light source comprises an incandescent lamp which mimics the appearance of a real burning candle.

One example of a floating candle is hollow and cylindrically-shaped with its outer surface dimensioned and configured to resemble a real candle. The floating candle includes a candle base which is hollow and cylindrically-shaped with its upper portion smaller than its lower portion. The floating candle also includes a candle enclosure which surrounds a lamp/candle complex and can be transparent, translucent, or appear in a variety of colors. The candle enclosure has an opening at its lower portion dimensioned and configured to pressure fit with the inward recess located within the upper portion of the candle base to promote a liquid-tight seal. The candle enclosure is pressure sealed to prevent shipping of water and designed to elevate the enclosure to float above water.

Second and third examples of the present invention are basically the same, however, the candle enclosure is designed and attached in a different manner. In any form of the invention, the candle is designed to float with its upper region above the surface of the water with the lower body of the candle.

The present invention additionally comprises electrical circuitry that controls the amount of power supplied to a floating candle. The floating candle further comprises an electrical plug, two conductor insulated wires, multi-conductor water tight splice trunk lines and feeder lines. Power is retrieved into a low voltage power supply section, then the voltage is modulated by a micro-controller, and then power is sent to driver transistors and output drivers which contain diodes. The power then travels through trunk and feeder lines that go to a specific set of floating candles.

There are three sections that comprise the electrical circuitry of the floating candles: a low voltage power supply (AC to DC, high to low voltage conversion), a pulse width modulation programmed micro-controller and power output section (to control the incandescent lamp voltage to produce flickering flames), and trunk and feeder lines. All under water electrical connections are spliced, soldered, insulated, siliconed, and covered with heat-shrink or any other method to prevent water damage.

Resistors provide resistance to the flow of electric current. Potentiometers are variable resistors used to change the brightness of the lamp within the floating candle device. Bipolar driver and output transistors are used to amplify the voltage sent to the trunk lines. The bipolar driver transistors which receive current from the potentiometers amplify current to a second set of transistors known as Darlington Pairs. Each Darlington Pair is connected to a rectifier diode. The trunk lines are spliced into feeder lines to allow the electrical current to go to the floating candles. Weights are strategically placed on the trunk and feeder lines to position the floating candle devices in a desired appearance.

Accordingly, it is a principal object of the invention to provide a floating candle which floats primarily with only its upper region exposed.

It is a further object of the invention to provide a floating candle which mimics real burning candles.

Still another object of the invention is to provide a floating candle which can be utilized as Christmas lights, at wedding reception halls, amusement parks, in pools, or in ponds at evening parties as decoration.

It is an object of the invention to provide improved elements and arrangements thereof in floating candles for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

Similar reference characters denote corresponding features consistently throughout the attached drawings.

DETAILED DESCRIPTION OF THE PREFERRED EMBODIMENTS

Figure 1:
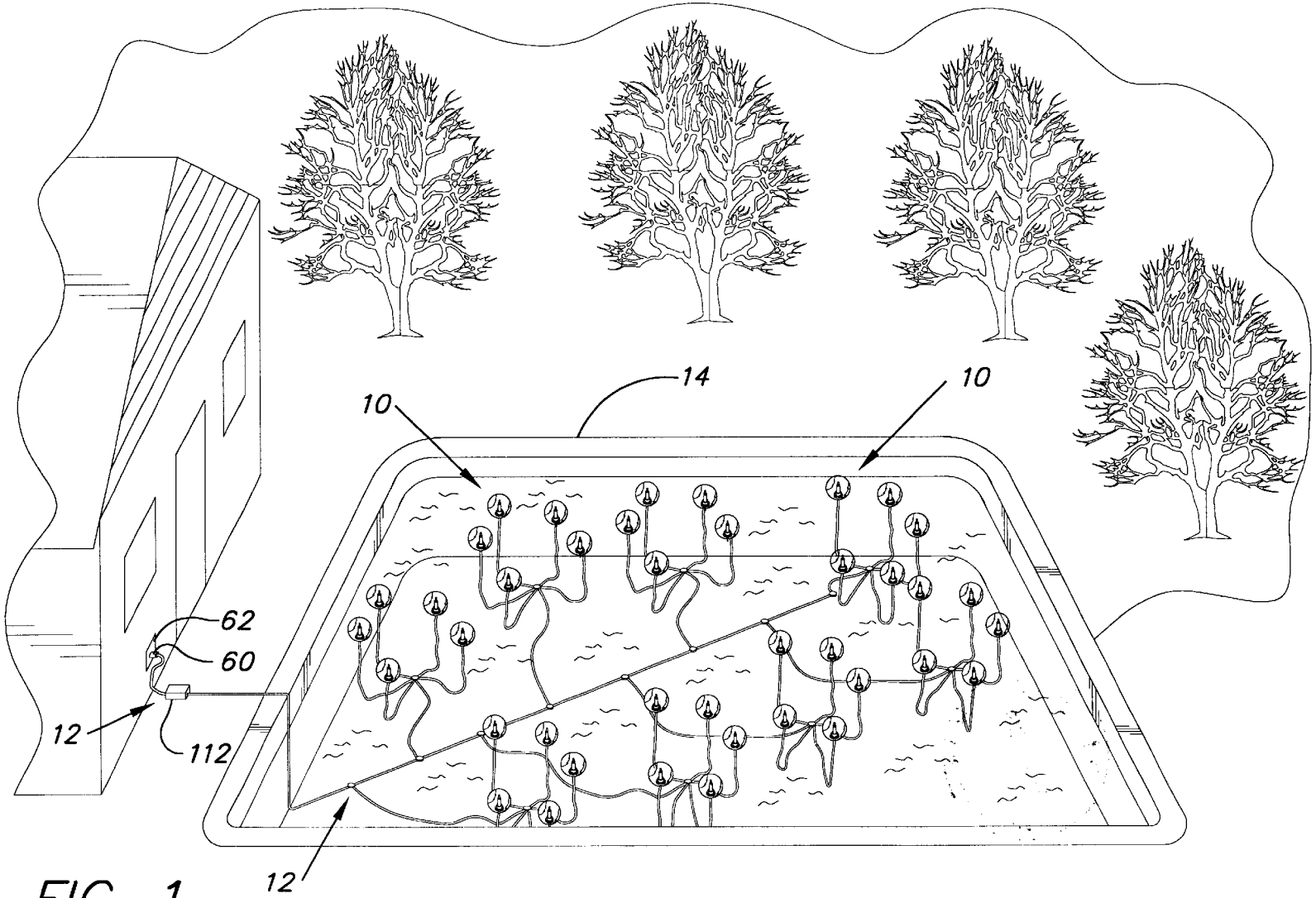
FIG. 1 is an environmental, perspective view of floating candles displayed in a pond according to the present invention.

The present invention is an electrically powered floating candle. FIG. 1 shows an arrangement of electrically powered floating candles displayed in a pool 14. The floating candle comprises two parts, a floating candle-like device 10 and electrical circuitry 12 that controls the amount of power supplied to each floating candle-like device 10. The floating candle arrangement further comprises an electrical plug 60 to receive line power from an electrical outlet 62.

Figure 2:
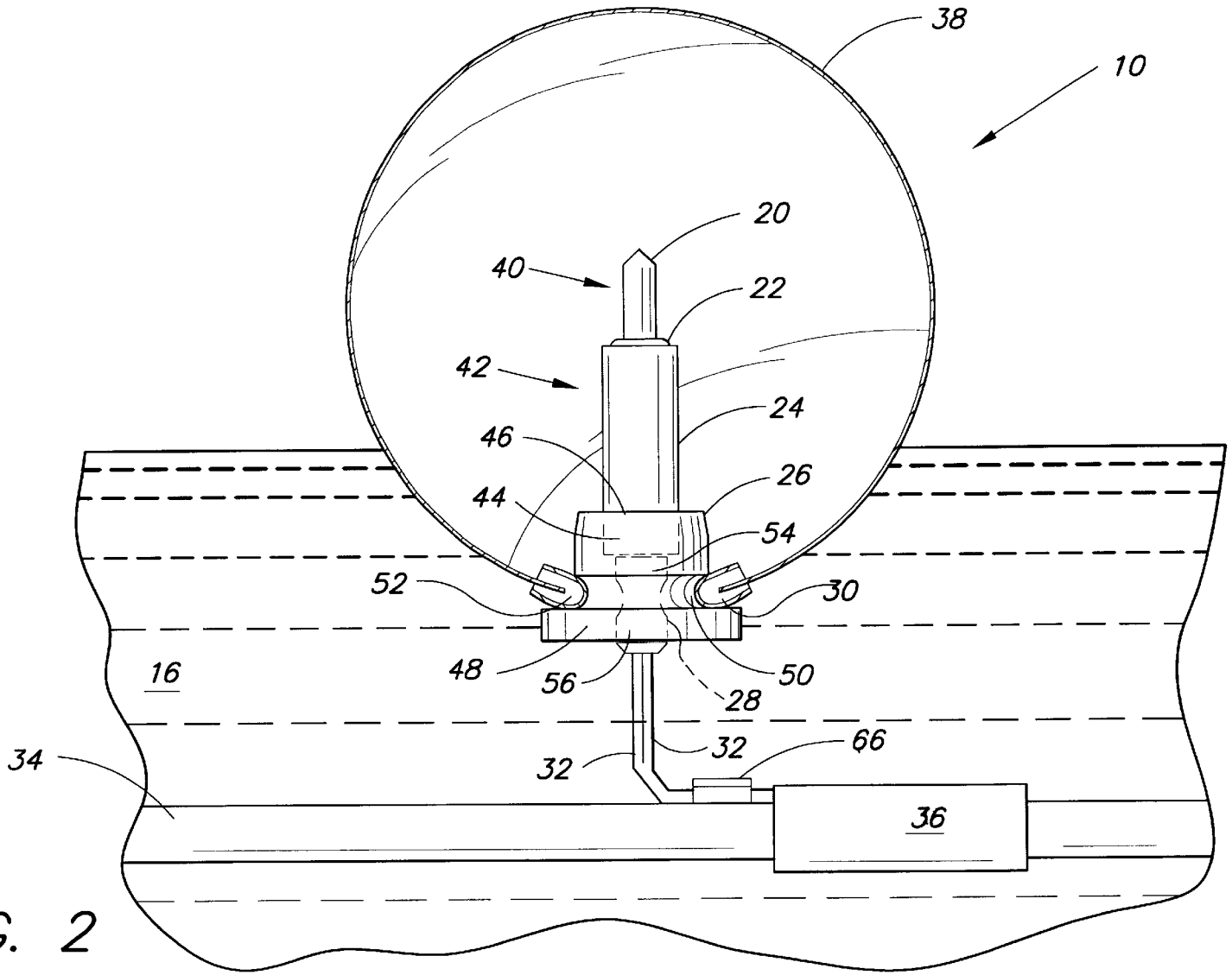
FIG. 2 is a side view of a floating candle of the present invention.

FIG. 2 shows one example of a floating candle-like device 10 in water 16. The floating candle-like device 10 comprises an incandescent lamp 20, a lamp housing socket 22, a candle 24, a candle base 26, a wire entry grommet 28, a pressure-fit grommet 30, at least two conductor insulated wires (feeder lines) 32, a multi-conductor trunk line 34, a water tight wire splice 36, and a candle enclosure 38.

The floating candle-like device 10 includes an incandescent lamp 20 which mimics the appearance of a real burning candle. The candle lamp 20 can be transparent, translucent, or appear in a variety of colors. The candle lamp 20 has an illuminating top portion 40 and a lower base portion (not shown). The illuminating top portion 40 extends out of a top portion 42 of the candle 24 with a lower base portion (not shown) sitting within the lamp housing socket 22 of the candle 24. The lamp housing socket 22 is dimensioned and configured to receive a lamp base. The lamp housing socket 22 is designed to anchor the base portion of the incandescent lamp 20 securely within the candle 24.

The candle 24 is hollow and cylindrically-shaped with its outer surface dimensioned and configured to resemble a real candle. The preferred composition of the candle 24 is plastic, however, any light weight material that resembles a real candle will suffice. The candle 24 has a top portion 42 and a lower portion 44. The candle 24 holds the (lamp)\(lamp housing socket) complex at its top portion 42 and its lower portion 44 is secured into the center of the candle base 26. The candle base 26 is hollow and cylindrically-shaped with its upper portion 46 smaller than its lower portion 48. The upper portion 46 of the candle base 26 contains an inward recess 50 which receives a structure that aids in sealing and protects the (lamp)/(lamp housing socket)/(candle) complex from any leakage. The lower portion 48 of the candle base 26 contains an opening dimensioned and configured to receive a wire entry grommet 28. The wire entry grommet 28 is secured to the candle base 26. The electrical wiring is run through the candle 24 via the wire entry grommet 28 and connects to the lamp housing socket 22 which is dimensioned and configured to receive the lamp base (not shown).

The candle enclosure 38 surrounds the (lamp)/(lamp housing socket)/(candle) complex and can be transparent, translucent, or appear in a variety of colors. The preferred shape of the candle enclosure 38 is spherical in shape, but it is not limited to this shape. The candle enclosure 38 has an opening at its lower portion dimensioned and configured to pressure-fit grommet 30 having an inward recess 50 located within the upper portion 44 of the candle base 26 to promote a liquid-tight seal. This is achieved by having the entire edge 52 of the opening in the lower end of the candle enclosure 38 lined with the pressure-fit grommet 30. The candle enclosure 38 is pressure sealed to prevent shipping of water and designed to elevate the candle enclosure 38 to float above water 16.

There are two different grommets utilized, a wire entry grommet 28 and a pressure-fit grommet 30. The wire entry grommet 28 has an upper 54 and lower 56 portion. The upper portion 54 of the wire entry grommet 28 extends through the candle base 26. The wire entry grommet 28 sits within the center of the candle base 26 and receives insulated conductor wires 32 and forms a water-tight seal.

Figure 3:
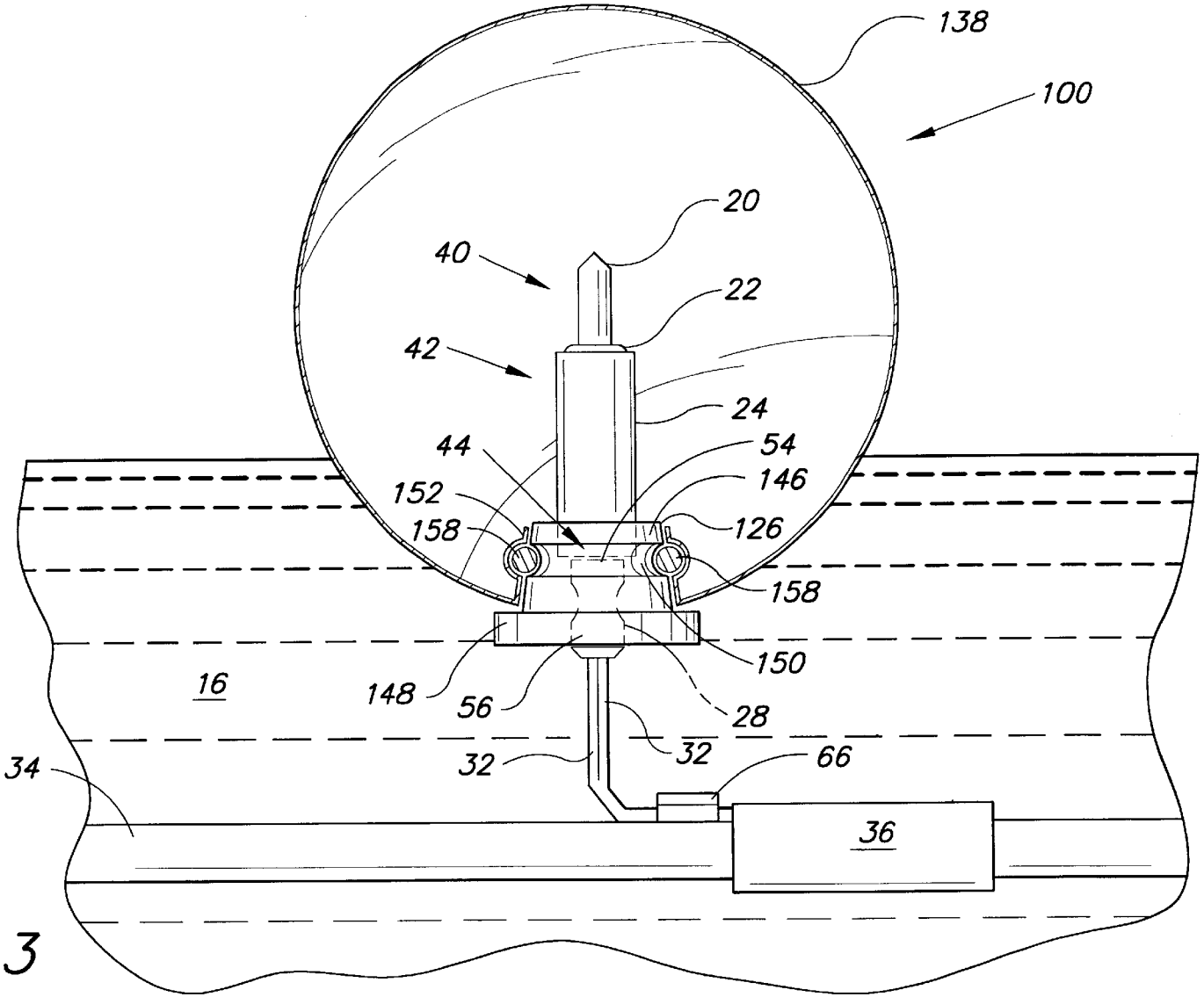
FIG. 3 is a side view of a second example of a floating candle of the present invention.

A second example of the present invention 100 is basically the same, as shown in FIG. 3, however, the candle enclosure 138 is designed and attached in a different manner. The floating candle-like device 100 comprises an incandescent lamp 20, a lamp housing socket 22, a candle 24, a candle base 126, a wire entry grommet 28, an O-ring 158, at least two conductor insulated wires (feeder lines) 32, a multi-conductor trunk line 34, a water tight wire splice 36, and a candle enclosure 138.

The floating candle-like device 100 includes an incandescent lamp 20 which mimics the appearance of a real burning candle. The candle lamp 20 can be transparent, translucent, or appear in a variety of colors. The candle lamp 20 has an illuminating top portion 40 and a lower base portion (not shown). The illuminating top portion 40 extends out of a top portion 42 of the candle 24 with a lower base portion (not shown) sitting within the lamp housing socket 22 of the candle 24. The lamp housing socket 22 is dimensioned and configured to receive a lamp base. The lamp housing socket 22 is designed to anchor the base portion of the incandescent lamp 20 securely within the candle 24.

The candle 24 is hollow and cylindrically-shaped with its outer surface dimensioned and configured to resemble a real candle. The preferred composition of the candle 24 is plastic, however, any light weight material that resembles a real candle will suffice. The candle 24 has a top portion 42 and a lower portion 44. The candle 24 holds the (lamp)\(lamp housing socket) complex at its top portion 42 and its lower portion 44 is secured into the center of the candle base 126. The candle base 126 is hollow and cylindrically-shaped with its upper portion 146 smaller than its lower portion 148.

The upper portion 146 of the candle base 126 in the second example also contains an inward recess 150 which accommodates a structure that aids in sealing the (lamp)/(lamp housing socket)/(candle) complex from any leakage. This inward recess 150 is dimensioned and configured to accommodate an O-ring 158. The candle enclosure 138 is dimensioned and configured to receive the O-ring 158 placed between the inward recess 150 of the candle base 126 and the opening of the candle enclosure 138 to promote a liquid-tight seal.

Figure 4:
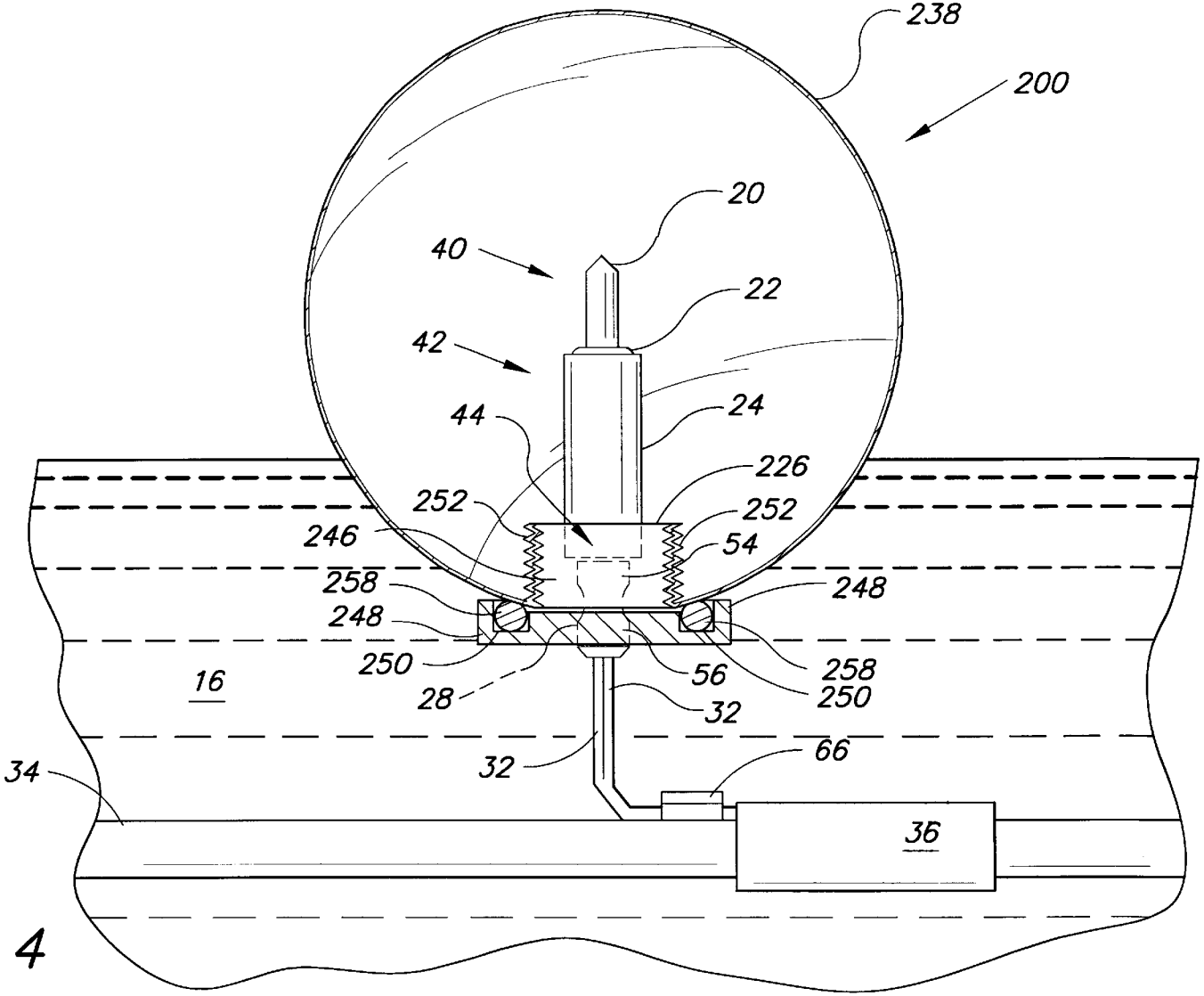
FIG. 4 is a side view in partial cross-section, of a third example of a floating candle of the present invention.

A third example of the present invention is shown in FIG. 4. The floating candle-like device 200 comprises an incandescent lamp 20, a lamp housing socket 22, a candle 24, a candle base 226, a wire entry grommet 28, an O-ring 258, at least two conductor insulated wires (feeder lines) 32, a multi-conductor trunk line 34, a water tight wire splice 36, and a candle enclosure 238.

The floating candle-like device 200 includes an incandescent lamp 20 which mimics the appearance of a real burning candle. The candle lamp 20 can be transparent, translucent, or appear in a variety of colors. The candle lamp 20 has an illuminating top portion 40 and a lower base portion (not shown). The illuminating top portion 40 extends out of a top portion 42 of the candle 24 with a lower base portion (not shown) sitting within the lamp housing socket 22 of the candle 24. The lamp housing socket 22 is dimensioned and configured to receive a lamp base. The lamp housing socket 22 is designed to anchor the base portion of the incandescent lamp 20 securely within the candle 24.

The candle 24 is hollow and cylindrically-shaped with its outer surface dimensioned and configured to resemble a real candle. The preferred composition of the candle 24 is plastic, however, any light weight material that resembles a real candle will suffice. The candle 24 has a top portion 42 and a lower portion 44. The candle 24 holds the (lamp)\(lamp housing socket) complex at its top portion 42 and its lower portion 44 is secured into the center of the candle base 226. The candle base 226 is hollow and cylindrically-shaped with its upper portion 46 smaller than its lower portion 48.

In addition to the O-ring 158 design described for the second example 100 (shown in FIG. 3), the candle enclosure 238 opening may also be dimensioned and configured to be screwed onto the upper portion 246 of the candle base 226 for a stronger support and to further prevent leakage within the candle enclosure 238 by the aid of the O-ring 258. The O-ring 258 is positioned within the inward recess 250 located at the lower portion 248, shown in cross-section, of the candle base 226. The edge 252 of the candle enclosure 238 extends upright and is threaded. Similar threading on the candle base 226 is dimensioned and configured to be screwed together with the edge 252 of the candle enclosure 238 to promote a liquid-tight seal. The candle enclosure 238 is dimensioned and configured to enable the floating candle-like device 200 to float unsupported in a stable upright position on the surface of the water 16. In any form of the invention, the floating candle-like device 200 is designed to float with its candle enclosure 238 above the surface of the water 16.

Figure 5:
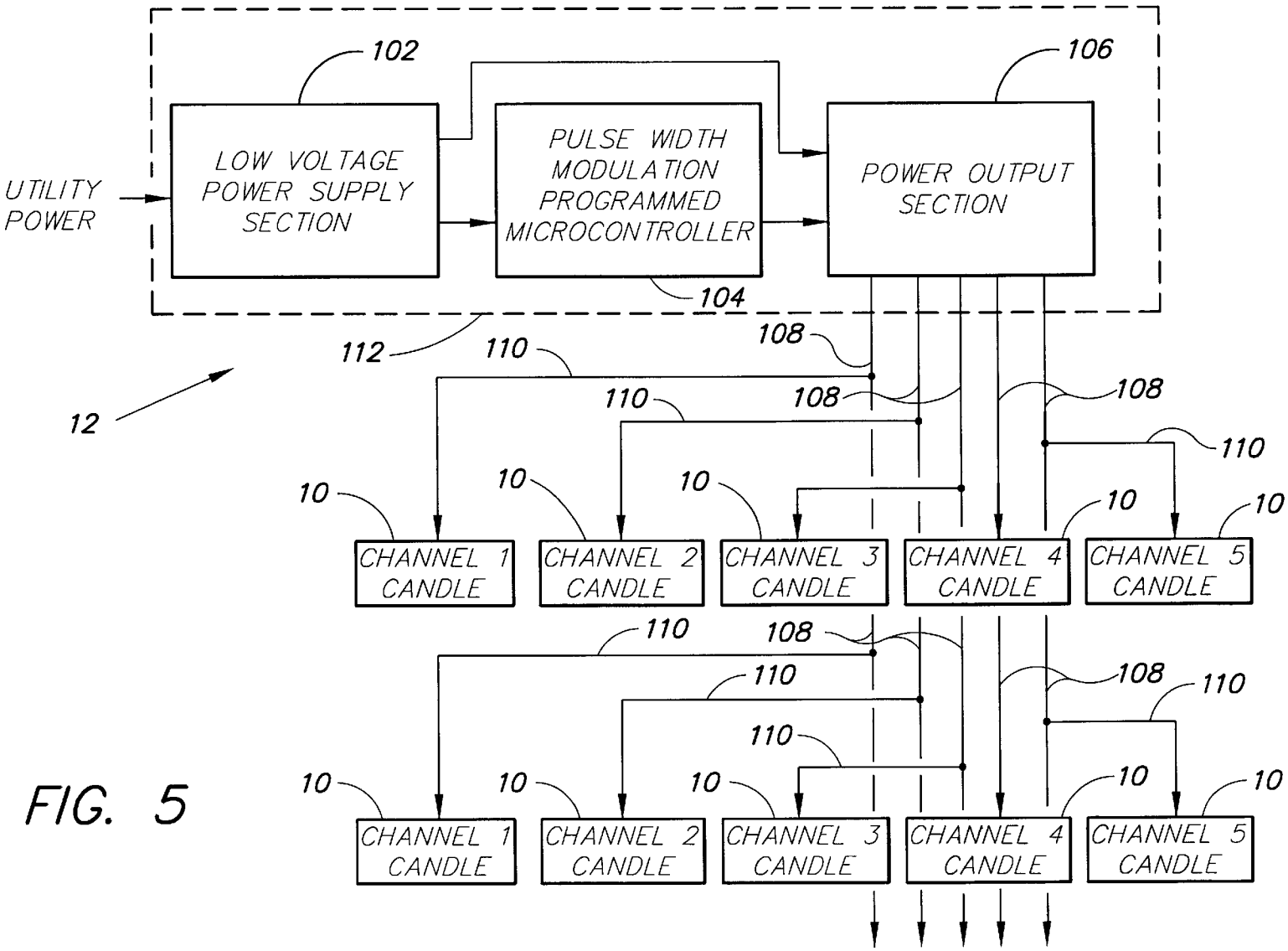
FIG. 5 is a circuit block diagram of the control system of the floating candles of the present invention.

The present invention additionally comprises electrical circuitry 12 that controls the amount of power supplied to each floating candle-like device 10. FIG. 5 shows a block diagram of the electrical circuitry 12. First, power is retrieved by a low voltage power supply section 102, then the voltage is modulated by a micro-controller 104, and also directed to a power output section 106. Power output section 106 comprises driver transistors and output drivers which contain diodes. Power then travels through trunk lines 108 and feeder lines 110, and goes to a specific set of floating candles.

There are three sections that comprise the electrical circuitry of the floating candles: a low voltage power supply section 102 (AC to DC, high to low voltage conversion), a pulse width modulation programmed micro-controller 104 and a power output section 106 (to control the incandescent lamp voltage to produce flickering flames), and the trunk lines 108 and feeder lines 110.

Sections 102, 104 and 106 make up a floating candle light controller. The power supply in section 102 converts line power (110VAC or 220VAC) to low voltage (DC). The conversion is to eliminate electrical shock and to extend the life of the lamp 20. The power supply section 102 is connected directly to the pulse width modulation programmed micro-controller 104 and the power output section 106.

The pulse width modulation programmed micro-controller 104 and the power output section 106 control the amount of power that is delivered to each set of floating candles. The candle flicker is produced by the micro-controller 104 randomly or programmed, altering the amount of power during a given time frame. The manipulation of power is achieved by the pulse width modulation micro-controller 104. The micro-controller 104 determines how long a voltage pulse will be delivered to each floating candle. Lamp 20 intensity can be determined by the power "on" time, the power supply voltage level, variable potentiometers PR6, PR7, PR8, PR9, and PR10 used for biasing, and the lamp filament voltage rating. The micro-controller 104 can also have at least one channel sending pulse width modulated voltage out to each floating candle device 10. It has been determined that more channels 110 give the floating candle-like devices 10 a more independent look. Therefore, the feeder lines 110 are not limited to five (shown in FIG. 1). The power output section 106, and micro-controller 104, and the low voltage power supply section 102 are contained in a waterproof housing 112. An electrical plug 60 connects to the waterproof housing 112 and the electrical outlet 62 (shown in FIG. 1). All outdoor electrical precautions are used.

In FIG. 5, the trunk line 108 will have at least one multiple pair of conductor wires. A PVC insulated cable is the most preferred. The trunk line 108 starts at the floating candle light controller and travels to multiple sites where floating candle-like devices 10 are located. single paired conductor insulated wires are then tied in between each floating candle-like device 10 and the trunk line 108. Floating candle-like devices 10 placed by each other should be connected on different channels to show independence. All underwater electrical connections are spliced, soldered, insulated, siliconed and covered with heat-shrink or any other method to prevent water damage. Multiple floating candle-like devices 10 can be wired in parallel and the low voltage power supply section 102 and the power output section 106 are built to handle any increased amount of current.

Figure 6:
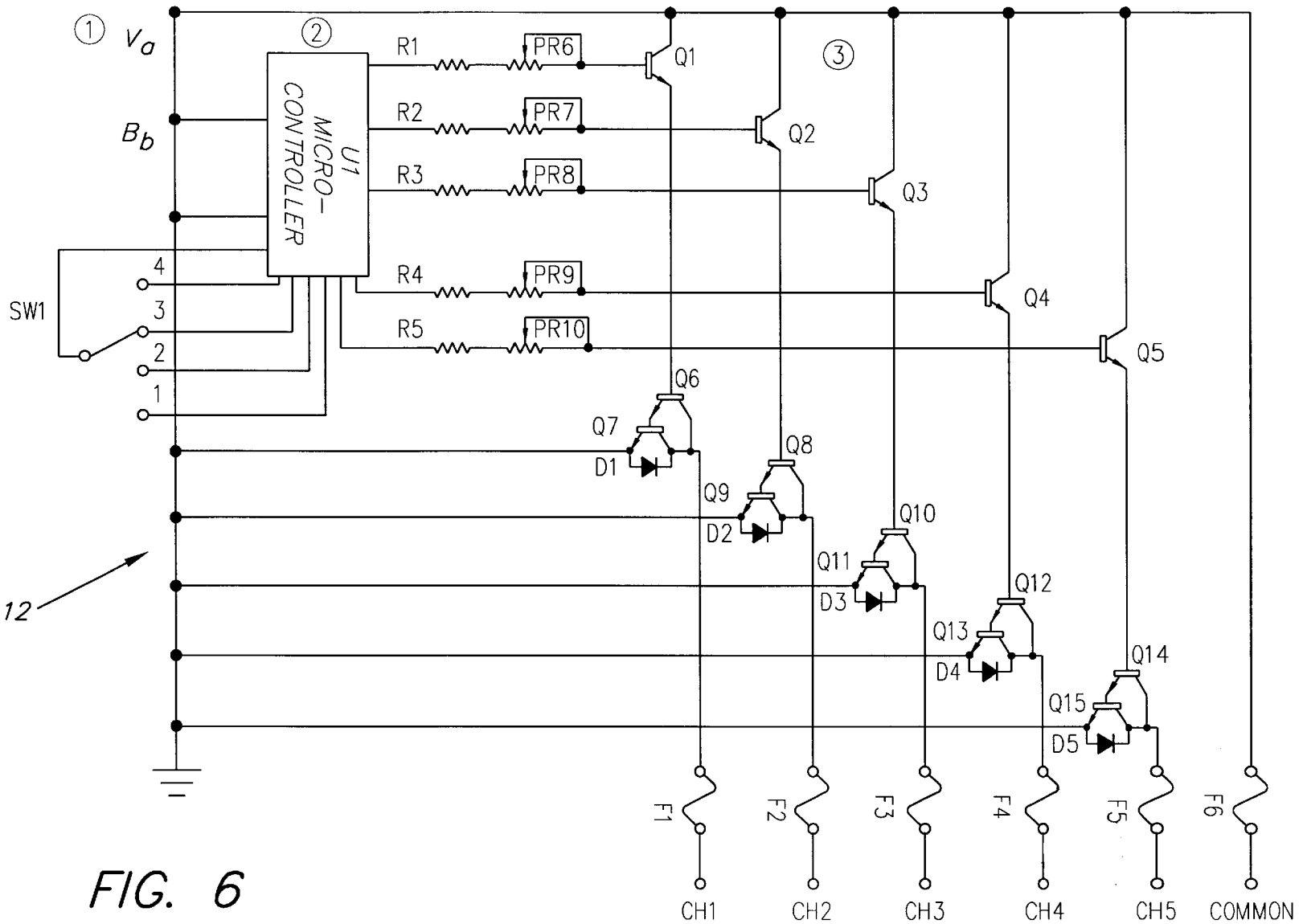
FIG. 6 is a schematic circuitry diagram of the control system of the floating candles of the present invention.

FIG. 6 shows the electrical circuitry 12 that controls the floating candles. The electrical circuitry 12 of the floating candles contain three parts including a switching module, a controlling module, and an amplifying module. SW1 is part of the switching module and is connected to the micro-controller U1 and represents a single pole control switch that toggles between four positions: (1) strobe; (2) flame A; (3) flame B; and, (4) constant. Line power is supplied from an outlet and travels to the low voltage power supply section 102. Low voltage power is connected to the micro-controller U1. Position (2) flame A and (3) flame B can represent many variables controlling the illumination timing of the floating candles. Some of the lamps 20 may have different color responses, may illuminate at different times from each other, or may illuminate simultaneously at different speeds and times.

The micro-controller U1, resistors R1–R5, and potentiometers PR6–PR10 are all part of the controlling module. Resistors R1–R5 provide resistance to the flow of electric current. Resistors R1–R5 are each connected in series with one corresponding potentiometer PR6–PR10. Resistors R1–R5 are each connected in series with potentiometers PR6–PR10 to add more resistance to the circuit. Resistors R1–R5 protect transistors Q1–Q5 from receiving too much current which may cause excessive heating. Potentiometers PR6–PR10 are variable resistors used to change the bias of the lamp 20 within the floating candle-like device 10.

Transistors Q1–Q15 and diodes D1–D5 are part of the amplifying module. Bipolar driver Q1–Q5 and output transistors Q6–Q15 are used to amplify the current sent to the trunk lines 34. The bipolar driver transistors Q1–Q5 receive current from potentiometers PR6–PR10 and amplify the current to a second set. of transistors Q6–Q7, Q8–Q9, Q10–Q11, Q12–Q13, Q14–Q15 known as Darlington Pairs. Each Darlington Pair Q6–Q7, Q8–Q9, Q10–Q11, Q12–Q13, Q14–Q15 is connected to a rectifier diode D1–D5. The Darlington pairs Q6–Q7, Q8–Q9, Q10–Q11, Q12–Q13, Q14–Q15 and the rectifier diodes D1–D5 prevent current from redirecting back to the Darlington pairs Q6–Q15. The rectifier diodes D1–D5 are connected to the Darlington pair transistors Q6–Q7, Q8–Q9, Q10–Q11, Q12–Q13, Q14–Q15 and are also used to key these devices in there safe operating area. The preferred diodes are fast-recovery rectifying diodes.

The current then flows through fuses F1–F6 to each channel through trunk lines 34 and feeder lines 32. Fuses are available in a number of sizes and shapes. They are used to prevent the damage caused by excess current flowing in a circuit. They are placed in series with trunk lines 34. Once too much current flows, it causes the fuse wire inside the fuse case to melt. This opens the circuit, stops the flow of current, and prevents overheating that occurs when too much current is present in the circuit. Trunk lines 34 are spliced into feeder lines 32 to allow electrical current to go to the floating candles. Weights 66 are strategically placed on the trunk lines 34 and feeder lines 32 to position the floating candle-like devices 10 in a desired appearance. The floating candle-like devices 10 are arranged in parallel.

The electrical floating candles are usually used as Christmas lights, at wedding reception halls, amusement parks, or in pools or ponds at evening parties as decoration. The floating candles can be arranged in letters to spell names and events, or be arranged to display shapes of objects or animals, etc. The uses for the floating candles are unlimited.

In the illustrated embodiment of the floating candles the circuit elements are preferably, but not limited to:

| Component | Part Number or rating |
|---|---|
| R1 | 470 Ω |
| R2 | 470 Ω |
| R3 | 470 Ω |
| R4 | 470 Ω |
| R5 | 470 Ω |
| PR6 | 10 kΩ |
| PR7 | 10 kΩ |
| PR8 | 10 kΩ |
| PR9 | 10 kΩ |
| PR10 | 10 kΩ |
| D1 | ECG588 |
| D2 | ECG588 |
| D3 | ECG588 |
| D4 | ECG588 |
| D5 | ECG588 |
| Q1 | 2N4013 |
| Q2 | 2N4013 |
| Q3 | 2N4013 |
| Q4 | 2N4013 |
| Q5 | 2N4013 |
| Q6, Q7 | TIP131 |
| Q8, Q9 | TIP131 |
| Q10, Q11 | TIP131 |
| Q12, Q13 | TIP131 |
| Q14, Q15 | TIP131 |
| U1 | PIC 16F84 micro-controller |

It is to be understood that the present invention is not limited to the embodiments described above, but encompasses any and all embodiments within the scope of the following claims.

I claim:

1. A floating candle device comprising:

a candle enclosure having an opening lined with material to promote sealing;

a candle base having upper and lower portions, said upper portion having an inward recess dimensioned and configured to receive said candle enclosure, wherein said opening of said candle enclosure extends upwards and is dimensioned and configured to pressure-fit with threads of said candle base that are to be screwed together, and is dimensioned and configured with said candle base to receive an O-ring for a liquid-tight seal, wherein said upper and lower portions of said candle base each have an opening dimensioned and configured to receive electrical wires and a grommet;

a grommet dimensioned and configured to fit into said opening in said lower portion of said candle base, said grommet having an opening dimensioned and configured to receive electrical wires, wherein said grommet, said candle base, and said candle enclosure are dimensioned and configured to fit together to promote a liquid-tight seal;

a candle-like structure having an upper portion that is dimensioned and configured to receive electrical wires;

a lamp having an illuminating end and a base end; and, a housing socket means dimensioned and configured to receive said base end of said lamp and to fit in said opening of said upper portion of said candle-like structure.

2. A floating candle device according to claim 1, wherein said candle enclosure is translucent, transparent, or colored.

3. A floating candle device according to claim 1, wherein said material in said opening of said candle enclosure has a pressure-fit grommet.

4. A floating candle device according to claim 1, wherein said opening of said candle enclosure extends upwards and is dimensioned and configured to pressure-fit with threads of said candle base that are to be screwed together, and is dimensioned and configured with said candle base to receive an O-ring for a liquid-tight seal.

5. A floating candle device comprising:

a candle enclosure having an opening dimensioned and configured to promote a liquid-tight seal with a candle base, wherein said opening in said candle enclosure is lined with material to promote sealing;

a candle base having upper and lower portions, said upper portion having an inward recess dimensioned and configured to receive said candle enclosure, wherein said upper and lower portions of said candle base each have an opening dimensioned and configured to receive electrical wires and a grommet;

a grommet dimensioned and configured to fit into said opening in said lower portion of said candle base, said grommet having an opening dimensioned and configured to receive electrical wires, wherein said grommet, said candle base, and said candle enclosure are dimensioned and configured to fit together to promote a liquid-tight seal;

a candle-like structure having an upper portion that is dimensioned and configured to receive electrical wires;

a lamp having an illuminating end and a base end; and, a housing socket means dimensioned and configured to receive said base end of said lamp and to fit in said opening of said upper portion of said candle-like structure;

wherein said floating candle device is arranged with other floating candle devices in letter and shapes.

6. A floating candle device according to claim 1, wherein said floating candle device is arranged electrically in parallel to other floating candle devices on the same channel.

7. An electrical floating candle device comprising:

a candle enclosure having an opening dimensioned and configured to promote a liquid-tight seal with a candle base, wherein said opening in said candle enclosure is lined with material to promote sealing, wherein said candle enclosure can be any shape and can be translucent, transparent, or colored;

a candle base having upper and lower portions, said upper portion having an inward recess dimensioned and configured to receive said candle enclosure, wherein said upper and lower portions of said candle base each have an opening dimensioned and configured to receive electrical wires and a grommet;

a grommet dimensioned and configured to fit into said opening in said lower portion of said candle base, said grommet having an opening dimensioned and configured to receive electrical wires, wherein said grommet, said candle base, and said candle enclosure are dimensioned and configured to fit together to promote a liquid-tight seal;

a candle-like structure having an upper portion that is dimensioned and configured to receive electrical wires;

a lamp having an illuminating end and a base end;

a housing socket means dimensioned and configured to receive said base end of said lamp, and to fit in said opening of said upper portion of said candle-like structure; and a circuit for turning the floating candle device on and off, said circuit having a power source.

8. An electrical floating candle device according to claim 7, wherein said candle enclosure can be any shape, said candle enclosure can be translucent, transparent, and colored.

9. An electrical floating candle device according to claim 7, wherein said material in said opening of said candle enclosure is a pressure-fit grommet.

10. An electrical floating candle device according to claim 7, wherein said opening of said candle enclosure extends upwards and is dimensioned and configured to pressure-fit with threads of threads of said candle base that are to be screwed together, and is dimensioned and configured with said candle base to receive an O-ring for a liquid-tight seal.

11. An electrical floating candle device according to claim 7, wherein said floating candle device is arranged with other floating candle devices in the form of letters and shapes.

12. An electrical floating candle device according to claim 7, wherein said floating candle device is arranged electrically in parallel to other floating candle devices on the same channel.

13. An electrical floating candle device according to claim 7, further comprising:

a switching module with at least one toggle position;

a controlling module having a low resistance network, and a microcontroller, wherein said resistance network comprises a plurality of resistors each connected in series with a potentiometer, wherein each potentiometer is connected in series with a bipolar driver transistor to vary the brightness of the said lamp within said floating candle device; and an amplifying module, said amplifying module comprises a bipolar driver transistor network, bipolar output transistor network, at least one fuse, at least one trunk line, at least one feeder line, said bipolar driver transistor network comprising a plurality of bipolar driver transistors each connected in series with a potentiometer with other said driver transistors to amplify current to said bipolar output transistor network, said bipolar output transistor network comprising at least one pair of bipolar output transistors accompanied by a rectifier diode to prevent current from redirecting back to the said at least one pair of bipolar output transistors, said rectifier diode being connected to a fuse which prevents damage caused by excess current, said trunk line providing a main current flow to said floating candle device, said feeder line being spliced from said trunk line to provide current flow to said floating candle device, said trunk line and said feeder line having a weight attached to position said floating candle device in a desired position, said at least one fuse being in series with said floating candle device through said trunk line and said feeder line.

14. An electrical circuit for a floating candle device comprising:

a switching module with at least one toggle position;

a controlling module having a low resistance network, and a microcontroller, wherein said resistance network comprises a plurality of resistors each connected in series with a potentiometer, wherein each potentiometer is connected in series with a bipolar driver transistor to vary the brightness of the said lamp within said floating candle device; and an amplifying module, said amplifying module comprises a bipolar driver transistor network, bipolar output transistor network, at least one fuse, at least one trunk line, at least one feeder line, said bipolar driver transistor network comprising a plurality of bipolar driver transistors each connected in series with a potentiometer and connected in parallel with other said driver transistors to amplify current to said bipolar output transistor network, said bipolar output transistor network comprising at least one pair of bipolar output transistors accompanied by a rectifier diode to prevent current from redirecting back to the said at least one pair of bipolar output transistors, said rectifier diode being connected to a fuse which prevents damage caused by excess current, said trunk line providing a main current flow to a floating candle device, said feeder line being spliced from said trunk line to provide current flow to a floating candle device, said trunk line and said feeder line having a weight attached to position floating candle devices in a desired position, said at least one fuse being in series with a floating candle device through said trunk line and said feeder line.

15. An electrical circuit for a floating candle device according to claim 14, wherein said toggle position within said switching module includes a position selected from the group consisting of a variety of strobe illuminating modes and a constant illuminating mode.

* * * * *